US007267580B2

(12) United States Patent
Huang et al.

(10) Patent No.: US 7,267,580 B2
(45) Date of Patent: Sep. 11, 2007

(54) CARD EDGE CONNECTOR HAVING HEAT-DISSIPATING MECHANISM

(75) Inventors: Hua-Yin Huang, ShenZhen (CN); Wei Yu, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/501,492

(22) Filed: Aug. 8, 2006

(65) Prior Publication Data

US 2007/0032117 A1 Feb. 8, 2007

(30) Foreign Application Priority Data

Aug. 8, 2005 (TW) ..... 94213419 U

(51) Int. Cl.
*H01R 24/00* (2006.01)

(52) U.S. Cl. ..... 439/637; 439/465

(58) Field of Classification Search ..... 439/260, 439/327, 637, 465, 205, 206, 267
See application file for complete search history.

(56) References Cited

U.S. PATENT DOCUMENTS 3,040,291 A * 6/1962 Schweitzer et al. ..... 439/637
3,509,519 A * 4/1970 Meylemans et al. ..... 439/634
3,614,707 A * 10/1971 Kaufmann et al. ..... 439/59
4,085,990 A * 4/1978 Jayne ..... 439/267
4,806,103 A * 2/1989 Kniese et al. ..... 439/60
5,059,133 A 10/1991 Hikami et al.
5,308,257 A * 5/1994 Buchter et al. ..... 439/267
5,672,069 A 9/1997 Cheng et al.
6,210,195 B1 4/2001 Ma
6,575,776 B1 * 6/2003 Conner et al. ..... 439/206
7,077,675 B2 * 7/2006 Maeda et al. ..... 439/260

* cited by examiner

*Primary Examiner*—Briggitte Hammond
*Assistant Examiner*—Larisa Tsukerman
(74) *Attorney, Agent, or Firm*—Wei Te Chung

(57) ABSTRACT

According to one embodiment of the present invention, a card edge connector (100) includes an elongated insulative housing (1) having a central slot (15) cooperatively enclosed by a bottom wall (150) and a pair of sidewalls thereof (13). A number of conductive terminals (2) are arranged along the central slot for mechanical and electrical engagement with a daughter circuit board (5) coupled thereto. The bottom wall of the housing defines a number of airways (151) in communication with the central slot, so as to dissipate heat generated by the conductive terminals during signal transmission to the outer circumstance timely.

11 Claims, 4 Drawing Sheets

CARD EDGE CONNECTOR HAVING HEAT-DISSIPATING MECHANISM

BACKGROUND OF THE INVENTION

1. Field of the Invention

The present invention generally relates to the field of electrical connectors. And more particularly, one embodiment of the present invention relates to a card edge connector having heat-dissipating mechanism for establishing stable electrical connection between a daughter circuit board and a mother circuit board.

2. General Background

Card edge connectors are widely used in various computer systems for forming electrical connection between a daughter circuit board and a mother circuit board. A card edge connector basically includes an elongated insulative housing defining a central slot for receiving a daughter circuit board therein and a number of conductive terminals set along the central slot. Each conductive terminal includes a contacting portion projecting to the central slot and a mounting portion to be connected to the mother circuit board. In use, the daughter circuit board is inserted into the central slot, with a mating edge thereof in mechanical and electrical engagement with the contacting portion of the conductive terminal.

The materials set forth in connection with this U.S. patent application describe a card edge connector—see e.g., U.S. Pat. Nos. 5,059,133, 5,672,069, and 6,210,195 which are hereby incorporated by reference.

With the trend of miniaturization of electrical device, space on the mother circuit board for a card edge connector is strictly limited. To reduce overall size of the card edge connector, conductive terminals in the housing are required to be arranged in a compact fashion. The compactly arranged conductive terminals potentially generate considerable amount of heat during signal transmission. Therefore, it is vital to disperse the heat to ambient environment timely. However, in the prior designs, the heat is only given out to the ambient environment primarily via the upwardly facing central slot and, therefore, cannot be dissipated timely and quickly. Accumulation of the heat possibly leads to distortion of the housing and adversely affects performance of the card edge connector, especially for power conductive terminals that conduct large currents.

Therefore, there is a heretofore unaddressed need in the industry to address the aforementioned deficiencies and inadequacies.

SUMMARY

According to one embodiment of the present invention, a card edge connector includes an elongated insulative housing having a central slot cooperatively enclosed by a bottom wall and a pair of sidewalls thereof. A number of conductive terminals are seated along the central slot for mechanical and electrical engagement with a daughter circuit board coupled thereto. The bottom wall of the housing is provided with a number of airways in communication with the central slot.

The embodiment of the present invention provides a card edge connector having heat-dissipating mechanism. The airways defined in the bottom wall of the housing offer additional heat-dissipating approaches to the outer circumstance, so as to accelerate air circulation and dissipate heat generated by the conductive terminals during signal transmission timely.

The present invention is illustrated by way of example and not limitation in the figures of the appended drawings, in which like references indicate identical elements, and in which:

DETAILED DESCRIPTION OF THE EMBODIMENT

Figure 1:
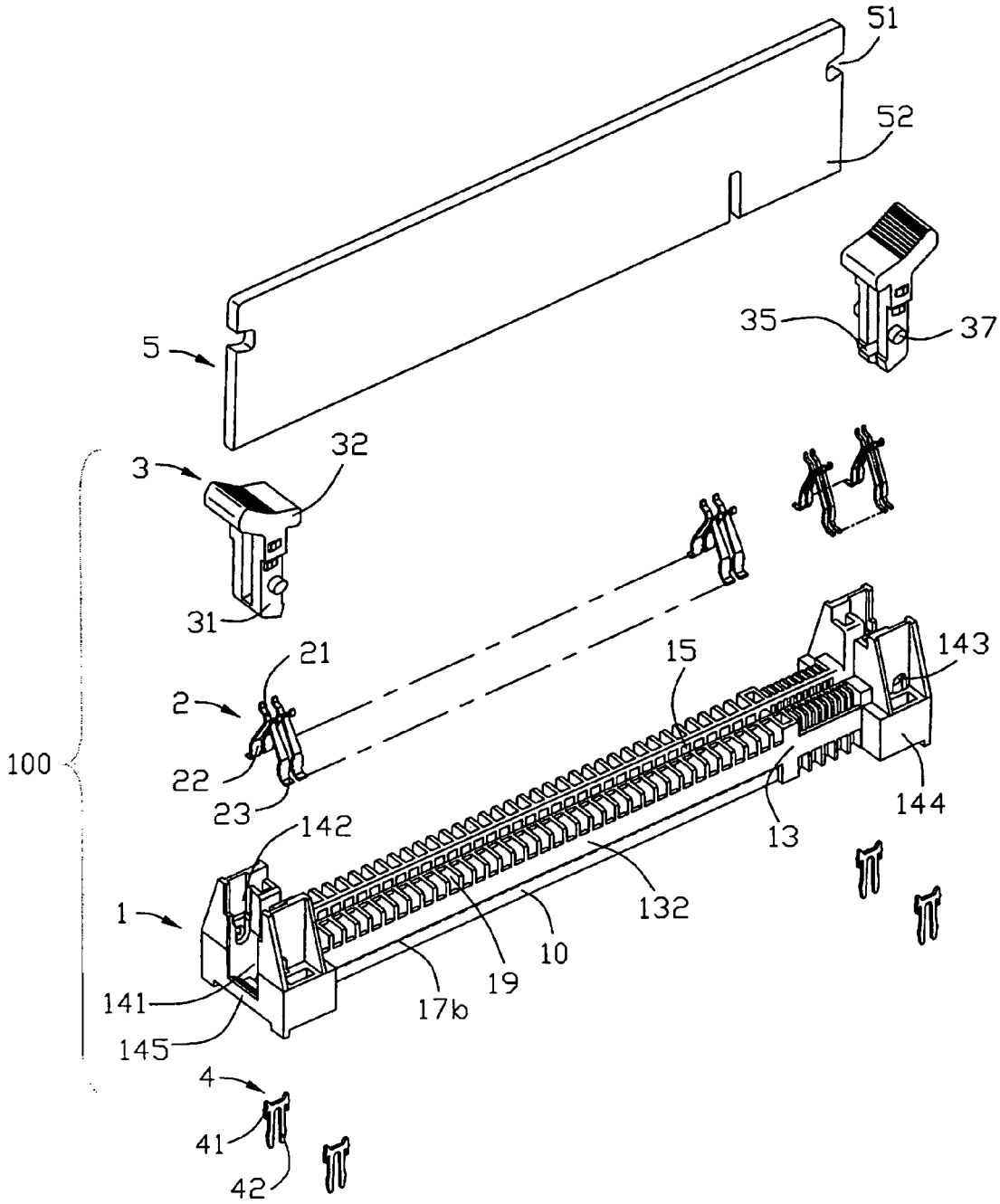
FIG. 1 illustrates an exemplary perspective, exploded view of a card edge connector according to an embodiment of the present invention.

In the following description, for purpose of explanation, numerous details are set forth in order to provide a thorough understanding of the embodiment of the present invention. However, it will be apparent to one skilled in the art that these specific details are not required in order to practice the embodiment of the present invention.

Referring to FIG. 1 to FIG. 4, a card edge connector 100 in accordance with an embodiment of the present invention includes an insulative housing 1 having a number of conductive terminals 2, a pair of latch/eject members 3 pivotally attached to two ends of the housing 1, and a number of board locks 4 coupled to the housing 1 for safely securing the card edge connector 100 on a mother circuit board (not shown).

Individual elements of the card edge connector 100 will now be described in greater detail. Referring to FIG. 1 to FIG. 4, the insulative housing 1 includes an elongated base section 10 extending along a longitudinal direction and a pair of towers 14 seated at two ends of the base section 10, respectively. The base section 10 includes a bottom wall 150 and a pair of parallel sidewalls 13 rising upwardly and vertically from the bottom wall 150. The bottom wall 150 and the sidewalls 13 cooperatively define a central slot 15 for receiving a card or a daughter circuit board 5 therein.

A number of passages 19 in communication with the central slot 15 are spaced longitudinally along each sidewall 13, for receiving a number of conductive terminals 2 therein, respectively. The passages 19 each include an opening 18 terminating at an inner surface 131 of the sidewall 13. In an alternative form of the present embodiment, the passage 19 further includes an upper channel 17*a* and a lower channel 17*b* terminating at an outer surface 132 of the sidewall 13, so as to offer heat-dissipating routes immediately connected to the outer circumstance. The bottom wall 150 of the housing 1 is provided with a number of airways 151 extending vertically therethrough, to supply additional heat-dissipating routes from the central slot 15 to outside. Preferably, the airway 151 is disposed between a pair of opposing conductive terminals 2.

Each tower 14 includes a pair of platforms 144 symmetrically oriented with respect to the central slot 15 and an over bridge 145 linking the platforms 144. The platforms 144 and the over bridge 145 jointly enclose a receiving chamber 141 to receive a latch/eject member 3 therein. Each platform 144 defines a stepped recess 142 facing the central slot 15 and a through-hole 143 for receiving a shaft 37 of the latch/eject member 3.

The conductive terminals 2 are received in the corresponding passages 19, respectively. Each conductive terminal 2 includes a retaining section 22 to be secured to the passage 19, an arched contacting section 21 projecting upwardly and angularly from the retaining section 22 for contacting with a mating edge 52 of the daughter circuit board 5, and a horizontal mounting section 23 for being mounted to the mother circuit board via a soldering mass attached thereto. As is known in this art, stand-offs (not shown) are provided so that the bottom surface of the bottom wall 150 is spaced from the mother circuit board to which the housing 1 is mounted.

The latch/eject member 3 is correspondingly housed in the receiving chamber 141 of the tower 14. Each latch/eject member 3 includes a vertically oriented main body 31, a locking arm 32 extending upwardly and obliquely from the main body 31 to lock the daughter circuit card 5 in position, a propping block 35 integrally formed with the main body 31 for releasing the daughter circuit board 5, and a pair of shafts 37 pivotally mountable in corresponding through-hole 143 of the housing 1, respectively.

A pair of board locks 4 are coupled to a bottom surface (not labeled) of each platform 144 of the tower 14. The board lock 14 includes a securing section 41 capable of being inserted into a groove (not shown) correspondingly defined in the platform 144 and a clipping section 42 extending downwardly from the securing section 41, to be inserted into a mounting hole (not shown) defined in the mother circuit board.

Figure 2:
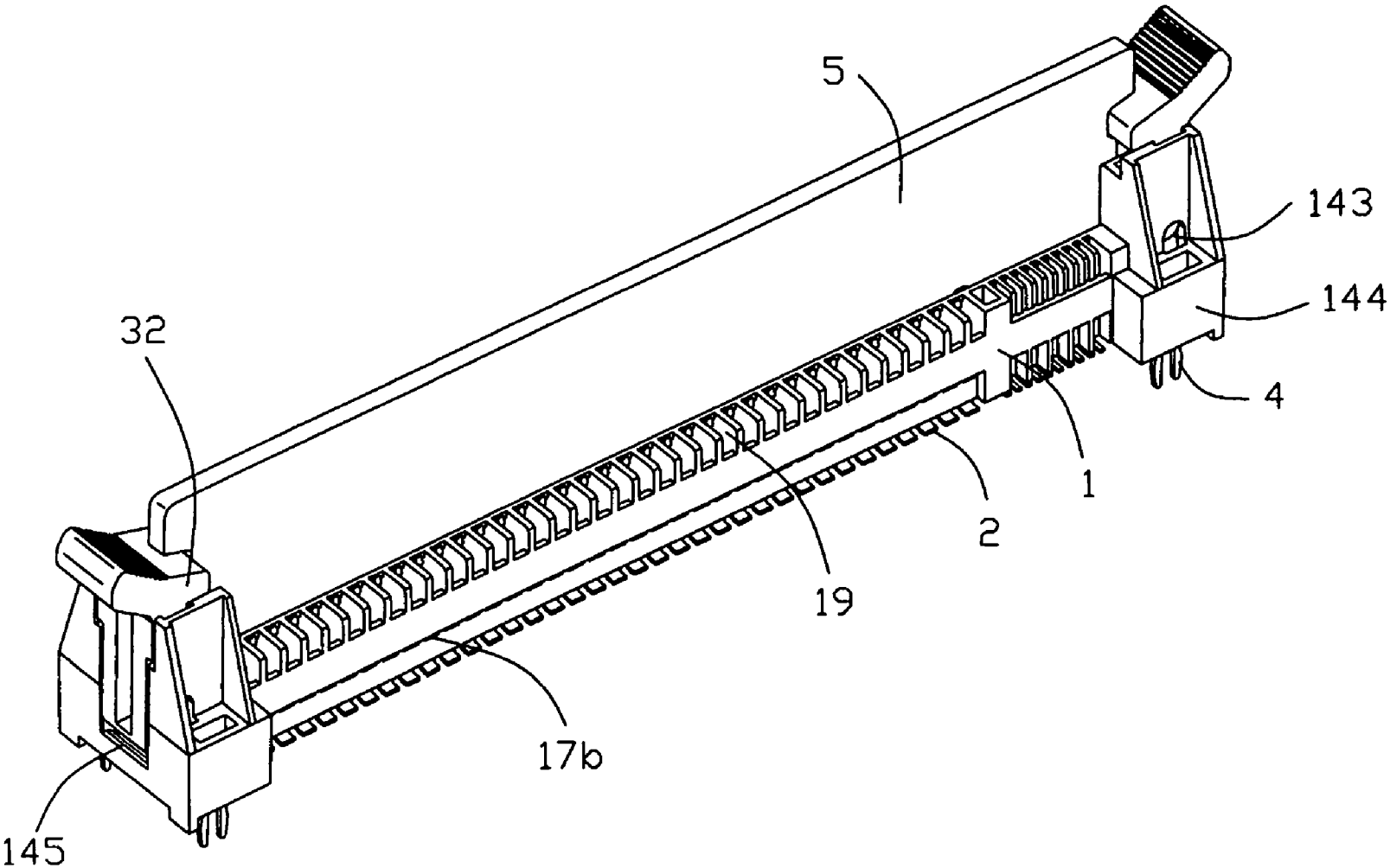
FIG. 2 illustrates an exemplary perspective, assembled view of the card edge connector of FIG. 1.
Figure 3:
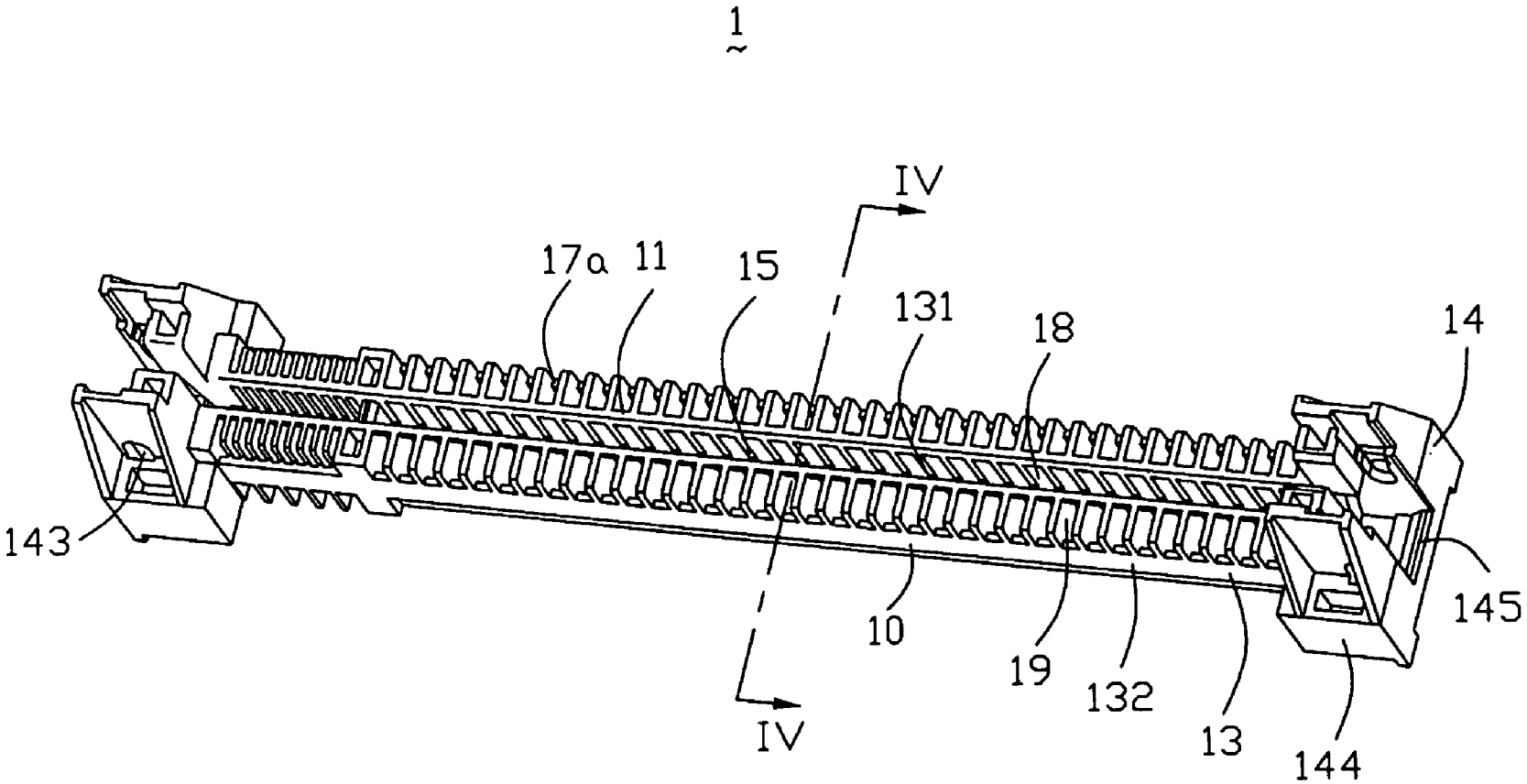
FIG. 3 illustrates an exemplary perspective view of an insulative housing for use with the card edge connector of FIG. 1.
Figure 4:
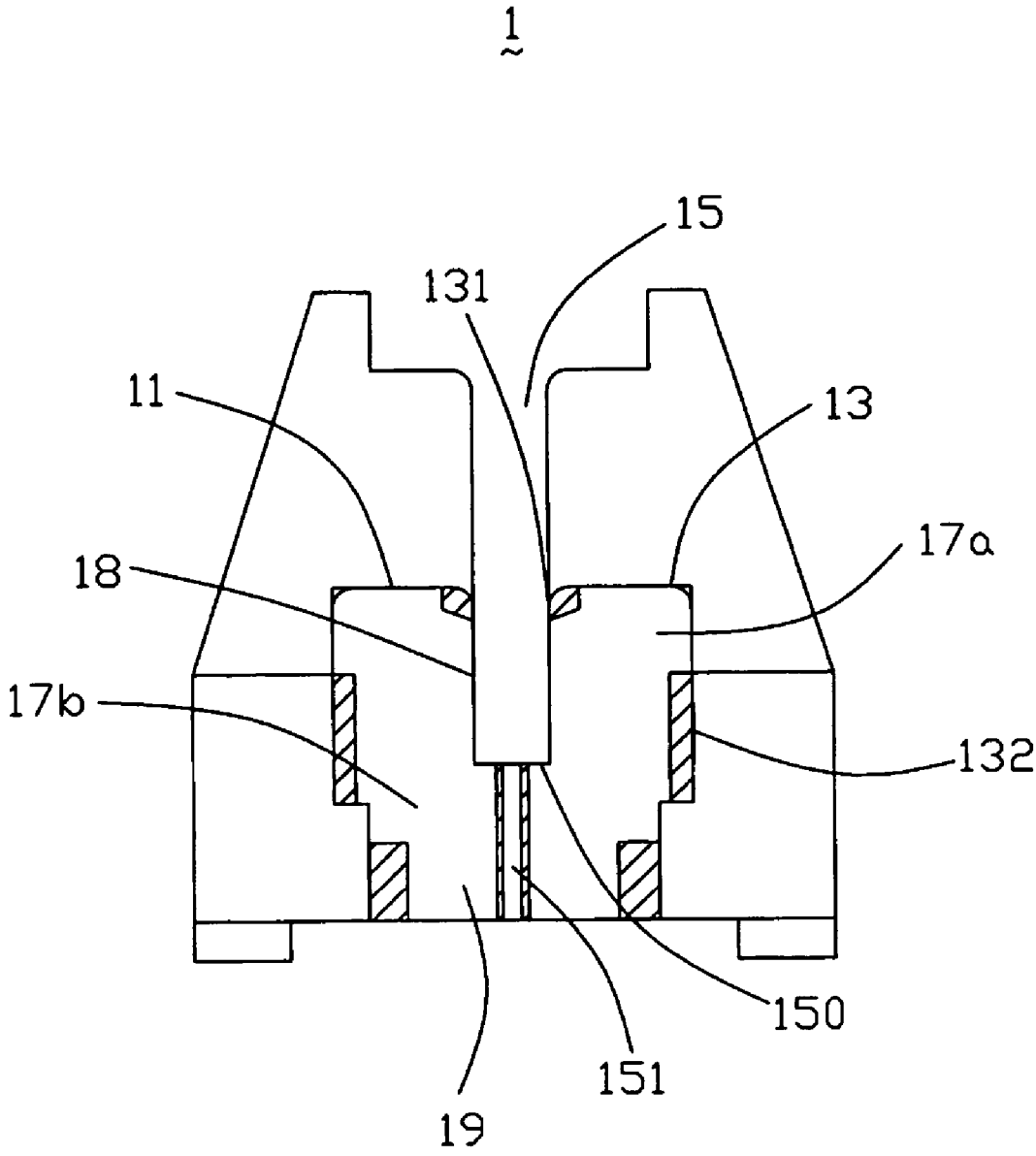
FIG. 4 illustrates an exemplary cross-sectional view of the housing of FIG. 3 taken along line IV-IV.

Referring to FIG. 1 and FIG. 2, in assembly of the card edge connector 100, the conductive terminals 2 are inserted into corresponding passages 19, respectively. The mounting portion 23 of the conductive terminal 2 protrudes downwardly beyond the base section 10 for being electrically connected to a soldering pad (not shown) on the mother circuit board. The contacting section 21 of the conductive terminal 2 pass through the opening 18 and projects into the central slot 15, for electrical and mechanical engagement with the mating edge 52 of the daughter circuit board 5. The latch/eject members 3 are positioned in corresponding receiving chamber 141, with the shafts 37 thereof pivotally assembled to the through-hole 143 defined in the platform 144. The board locks 4 are correspondingly inserted into the grooves defined in the platform 144.

During assembling the daughter circuit card 5 to the card edge connector 100 seated on the mother circuit board, the latch/eject members 3 are rotated afar with respect to the base section 10. The daughter circuit card 5 is suitably inserted into the central slot 15, with the mating edge thereof being in electrical and mechanical engagement with the conductive terminals 2. The latch/eject members 3 are urged to rotate toward the daughter circuit board 5, to lock the daughter circuit board 5 in position via engagement between the locking arms 32 thereof and side notch 51 on the daughter circuit card 5, thereby forming stable electrical connection between the daughter circuit board 5 and the mother circuit card.

In connection with the preceding description, arrangement of the airways 151 of the card edge connector 100 according to an embodiment of the present invention can provide additional channels for heat dissipation, which may accelerate air circulation and dissipate the heat generated by the conductive terminals during signal transmission timely and effectively.

While the present invention has been illustrated by description of embodiment thereof, and while the embodiment have been described in considerable detail, it is not intended to restrict or in any way limit the scope of the appended claims to such details. Additional advantages and modifications in the spirit and scope of the present invention will readily appear to one skilled in the art. Therefore, the present invention is not limited to the specific details and illustrative examples shown and described.

What is claimed is:

1. A card edge connector mountable on a mother circuit board, the card edge connector comprising:

an elongated insulative housing comprising a bottom wall and a pair of parallel sidewalls each defining a plurality of passages therein, the bottom wall and the sidewalls jointly enclosing a central slot to receive a daughter circuit card therein; and a plurality of conductive terminals residing in corresponding passages, respectively, the conductive terminals each comprising a contacting section projecting to the central slot to electrically and mechanically mate with the daughter circuit board and a mounting section to be mounted to the mother circuit board, and wherein the bottom wall of the housing defines a plurality of airways in communication with the central slot; wherein the airways are aligned with a pair of opposing conductive terminals; and wherein the side walls define a plurality of passageways along a lengthwise direction, and the terminals are respectively disposed in the corresponding passageways, under a condition that the airways does not laterally communicate with the corresponding passageways.

2. The card edge connector of claim 1, wherein the passage comprises an opening terminating at an inner surface of the sidewall.

3. The card edge connector of claim 1, wherein the passage comprises an upper channel and a lower channel terminating at an outer surface of the sidewall.

4. The card edge connector of claim 1, wherein the housing comprises a pair of towers at two ends thereof, a plurality of board locks are coupled to the towers to securely mount the housing on the mother circuit board.

5. The card edge connector of claim 4, wherein the tower comprises a pair of platforms and an over bridge linking the platforms, the platforms and the over bridge jointly define a receiving chamber.

6. The card edge connector of claim 5, wherein a pair of latch/eject members are pivotally assembled in the receiving chambers, respectively, to lock the daughter circuit board in position.

7. An electrical connector comprising:

an elongated insulative housing having a central slot cooperatively enclosed by a bottom wall and a pair of sidewalls thereof, the bottom wall defining a plurality of airways in communication with the central slot; and a plurality of conductive terminals spaced along the central slot for mechanical and electrical engagement with an electronic component coupled thereto:

wherein the airways vent heat generated in the housing out through a bottom surface of the bottom wall of the housing;

wherein the airways are aligned with a pair of opposing conductive terminals; and wherein the side walls define a plurality of passageways along a lengthwise direction and in communication with a central slot, and the terminals are respectively disposed in the corresponding passageways, under a condition that the airways does not laterally communicate with the corresponding passageways.

8. The electrical connector of claim 7, wherein the passages each comprise an opening terminating at an inner surface of the sidewall.

9. The electrical connector of claim 7, wherein the passages each comprise at least one channel immediately connected to outer circumstance.

10. The electrical connector of claim 7, wherein the housing comprise a pair of towers seated at two ends thereof, each tower defines a receiving chamber therein.

11. The electrical connector of claim 10, wherein pair of latch/eject members is movably coupled to the receiving chambers, respectively, for locking the electronic component in position.

* * * * *